US006637045B1

(12) United States Patent
Larsen

(10) Patent No.: US 6,637,045 B1
(45) Date of Patent: Oct. 28, 2003

(54) PORTABLE POOLSIDE CHAIR APPARATUS

(76) Inventor: Alexander K. Larsen, 23 Stuart Rd., Ronde Bosch, Cape Town 7700 (ZA)

( * ) Notice: Subject to any disclaimer, the term of this patent is extended or adjusted under 35 U.S.C. 154(b) by 0 days.

(21) Appl. No.: 10/086,829

(22) Filed: Mar. 1, 2002

(51) Int. Cl.[7] ..... E04H 4/00
(52) U.S. Cl. ..... 4/496; 297/14
(58) Field of Search ..... 4/496, 579; 297/14, 297/255, 256; 182/54, 55; 114/362

(56) References Cited

U.S. PATENT DOCUMENTS

| | | | | | |
|---|---|---|---|---|---|
| 1,245,660 | A | | 11/1917 | Behm | |
| 1,270,738 | A | * | 6/1918 | Jones | 297/14 |
| 2,888,061 | A | * | 5/1959 | Berlin | 297/14 |
| 4,837,869 | A | | 6/1989 | Simmon | |
| 4,893,363 | A | | 1/1990 | Huff | |
| 5,307,527 | A | | 5/1994 | Schober | |
| D351,740 | S | | 10/1994 | Tesmer | |
| 5,857,226 | A | * | 1/1999 | Sommer | 4/496 |
| D406,474 | S | | 3/1999 | Toledo et al. | |
| 6,311,343 | B1 | * | 11/2001 | Wisniewski | 4/496 |

* cited by examiner

*Primary Examiner*—Charles E. Phillips

(57) ABSTRACT

A portable poolside chair apparatus for permitting a user to sit partially submerged in a pool adjacent the pool wall. The portable poolside chair apparatus includes a plurality of frame sections. A pool deck portion that is placed on the pool deck surface adjacent the pool wall and is designed to support the structure. A backrest portion that includes armrests, contacts the pool wall, and supports the user's back. A seat portion is positioned at the lower end of the backrest portion, protrudes outwardly into the pool, and is designed for supporting the user. The aforementioned portions are pivotally coupled making the unit foldable. The backrest and seat portions each include a selectively couplable cushion member for comfort.

18 Claims, 4 Drawing Sheets

PORTABLE POOLSIDE CHAIR APPARATUS

BACKGROUND OF THE INVENTION

1. Field of the Invention

The present invention relates to pool chairs and more particularly pertains to a new portable poolside chair apparatus for permitting a user to sit partially submerged in a pool adjacent the pool wall:

2. Description of the Prior Art

The use of pool chairs is known in the prior art. U.S. Pat. No. 4,893,363 describes a hanging wall table for swimming pools. Another type of pool chairs is U.S. Pat. No. 5,307,527 having a rigid design which hangs on the pool wall.

While these devices fulfill their respective, particular objectives and requirements, the need remains for a device that is not only functional, but practical with regards to ease of use, storage, and portability.

SUMMARY OF THE INVENTION

The present invention meets the needs presented above by being collapsible into substantially flat dimensions, making it readily transportable and easily storable.

Still yet another object of the present invention is to provide a new portable poolside chair apparatus that has an adjustable seat portion that allows the user to vary the depth of the water in which he is submersed.

Even still another object of the present invention is to provide a new portable poolside chair apparatus that has cushions for optimum comfort.

To this, the present invention generally comprises a plurality of frame sections. A pool deck portion that is placed on the pool deck surface adjacent the pool wall and is designed to support the structure. A backrest portion that includes armrests, contacts the pool wall, and supports the user's back. A seat portion is positioned at the lower end of the backrest portion, protrudes outwardly into the pool, and is designed for supporting the user. The aforementioned portions are pivotally coupled making the unit foldable. The backrest and seat portions each include a selectively couplable cushion member for comfort.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty that characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
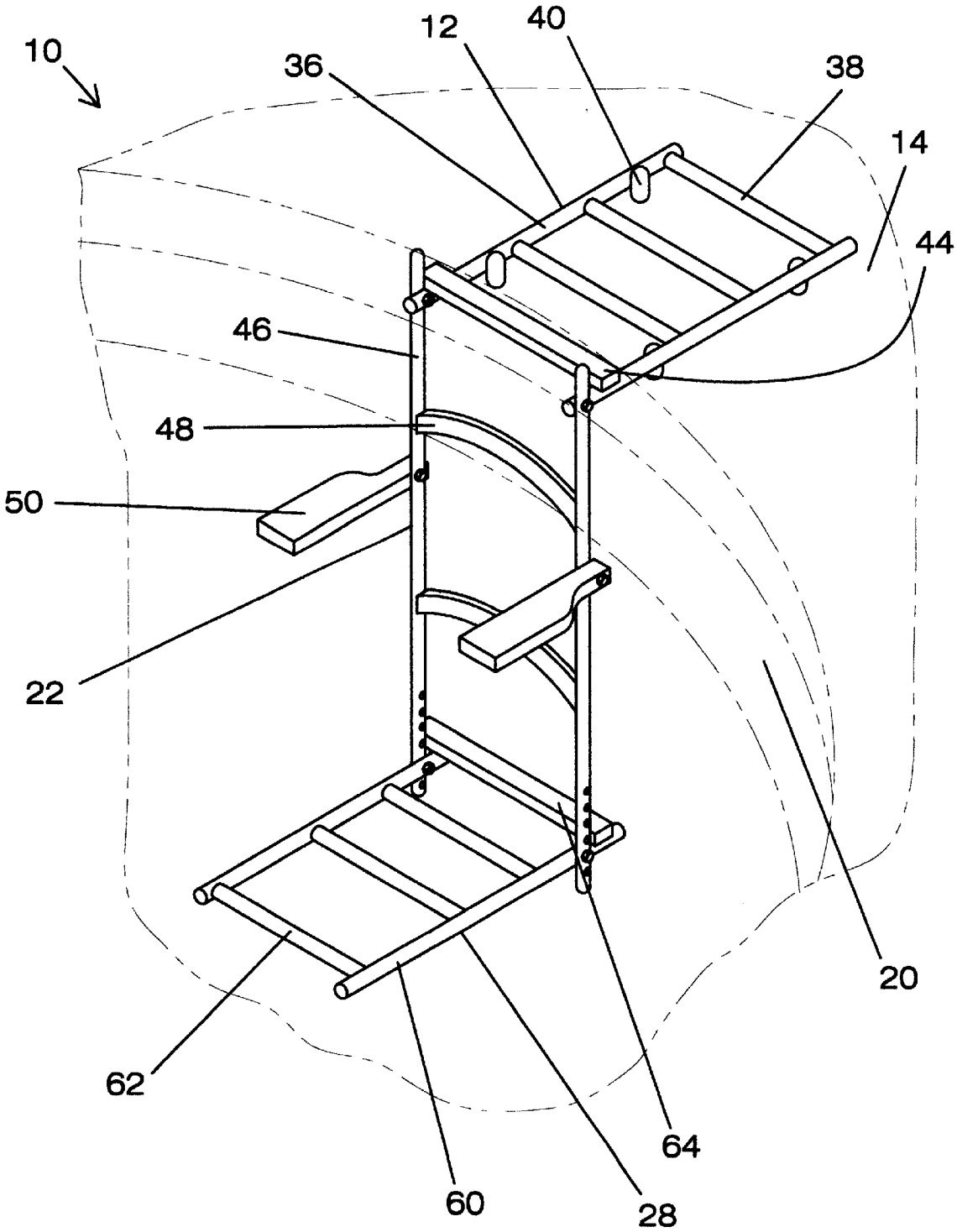
FIG. 1 is a schematic perspective view of a new portable poolside chair apparatus according to the present invention.
Figure 2:
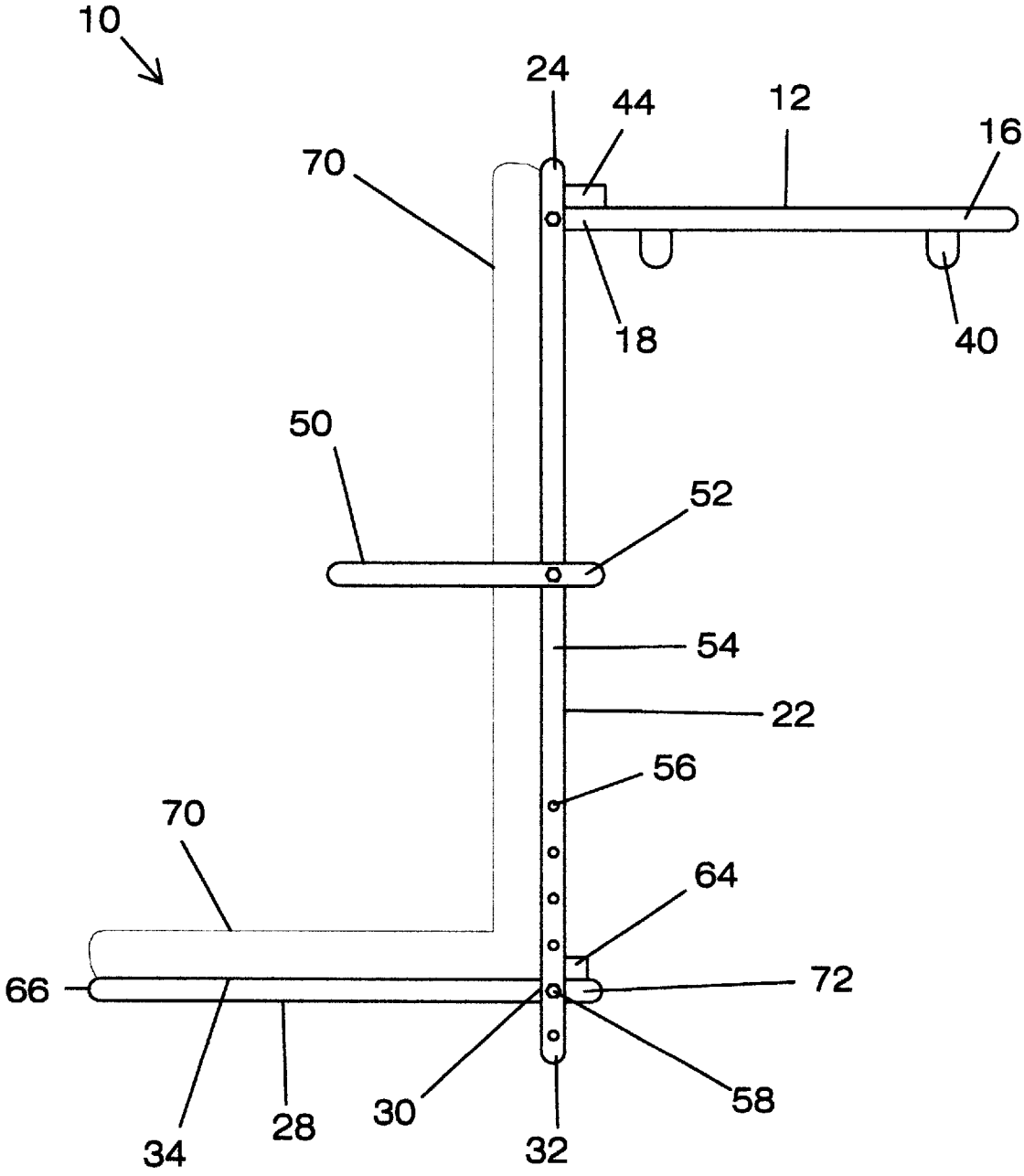
FIG. 2 is a schematic side view of the present invention.
Figure 3:
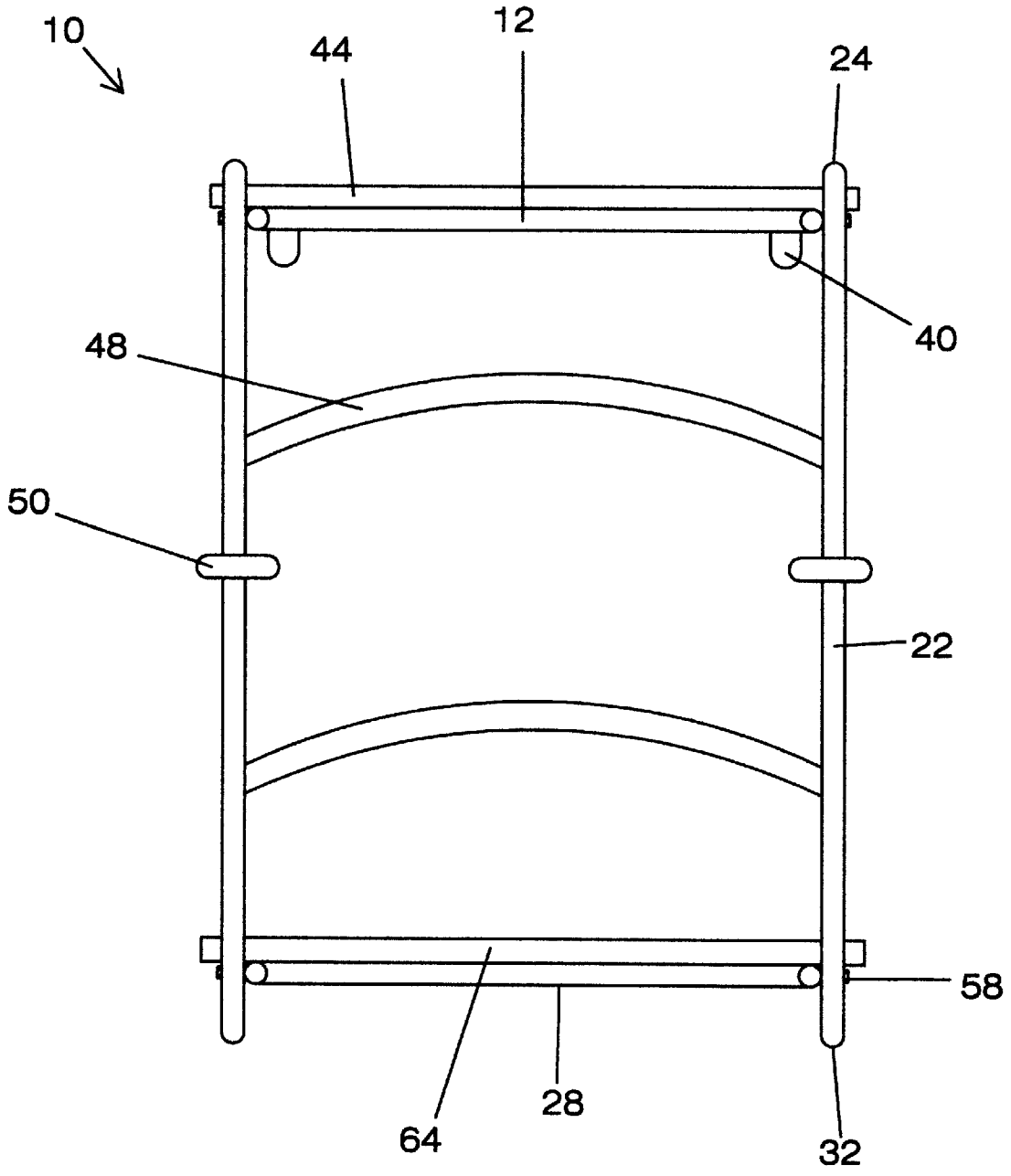
FIG. 3 is a schematic front view of the present invention.
Figure 4:
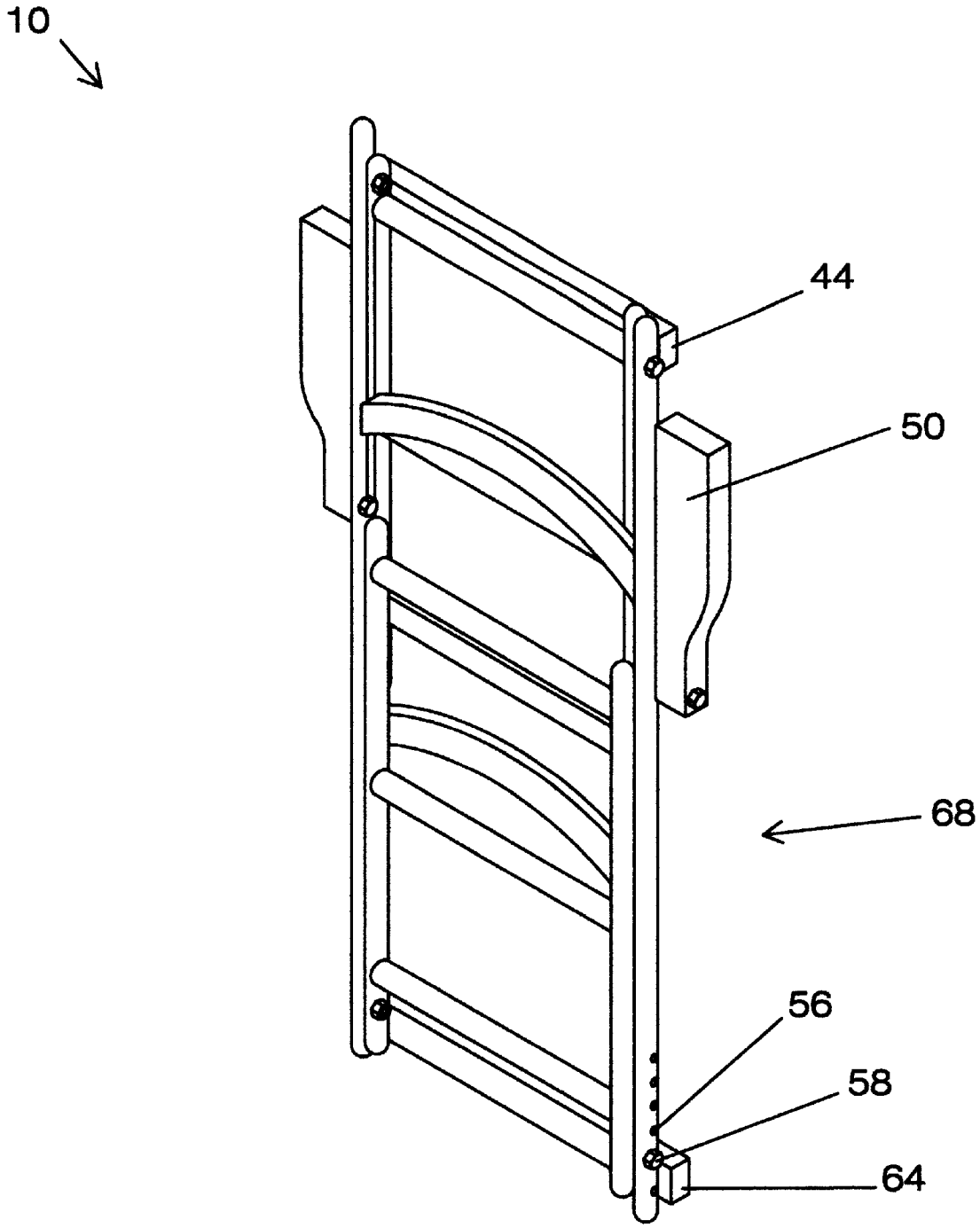
FIG. 4 is a schematic perspective view of the present invention in the folded position.

With reference now to the drawings, and in particular to FIGS. 1 through 4 thereof, a new portable poolside chair apparatus embodying the principles and concepts of the present invention and generally designated by the reference numeral 10 will be described.

As best illustrated in FIGS. 1 through 4, the portable poolside chair apparatus 10 generally comprises a pool deck portion 12. The pool deck portion 12 may be positioned on the pool deck surface 14 such that a distal end 16 and a proximal end 18 of the pool deck portion 12 are defined with respect to the pool wall 20.

A backrest portion 22 has an upper end 24 pivotally coupled to the proximal end 18 of the pool deck portion 12. The pool deck portion 12 may be moved from a position abutting the backrest portion 22 to a position oriented generally perpendicular to the backrest portion 22. The backrest portion 22 is oriented substantially perpendicular to the pool deck portion 12 when the pool deck portion 12 is positioned on the pool deck surface 14.

A seat portion 28 has an edge 30 pivotally coupled to a lower end 32 of the backrest portion 22 such that the seat portion 28 may be moved from a position abutting the backrest portion 22 to a position oriented generally perpendicular to the backrest portion 22.

Wherein, the backrest portion 22 may be positioned against the pool wall 20 and the pool deck portion 12 positioned on the pool deck surface 14 such that the seat portion 28 extends away from the pool wall 20 and defines a seat 34.

The pool deck portion 12 has a plurality of support bar members 36. The support bar members 36 are substantially parallel. A plurality of crossbar members 38 is fixedly coupled to the support bar members 36. The crossbar members 38 are oriented substantially perpendicular to the support bar members 36 thereby forming the pool deck portion 12.

The pool deck portion 12 has a plurality of support members 40. The support members 40 are fixedly coupled to the support bar members 36. The support members 40 comprise a friction-enhancing material such that the support members 40 are for contacting the pool deck surface 14 while preventing movement of the pool deck portion 12 when the backrest portion 22 is extended into the pool.

The pool deck portion 12 includes a crossbar stop member 44. The crossbar stop member 44 is fixedly coupled to the support bar members 36 proximate the proximal end 18 of the pool deck portion 12. The crossbar stop member 44 abuts the upper end 24 of the backrest portion 22 when the distal end 16 of the pool deck portion 12 is pivoted upwardly. The crossbar stop member 44 prevents from moving past a perpendicular relationship between the pool deck portion 12 and the backrest portion 22 when the portions 12, 22 are in contact with the pool wall 20 and the pool deck surface 14.

The backrest portion 22 has a plurality of wall members 46. The wall members 46 are substantially parallel. A plurality of bracket members 48 is fixedly coupled to the wall members 46. The bracket members 48 are oriented substantially perpendicular to the wall members 46 thereby forming the backrest portion 22.

The bracket members 48 are generally arcuate such that the bracket members 48 are for conforming to the back of the user.

The backrest portion 22 includes a plurality of armrest members 50. The armrest members 50 comprise substantially flat elongate members. A rear end 52 of the armrest members 50 are pivotally coupled to the wall members 46 proximate a medial portion 54 of the wall members 46. The armrest members 50 are designed for supporting the arms of the user when the user is positioned on the seat portion 28.

The backrest portion 22 has a plurality of seat adjustment holes 56. The seat adjustment holes 56 are positioned proximate the lower end 32 of the backrest portion 22 in the wall members 46 such that the seat adjustment holes 56 are for vertical positioning of the seat portion 28 along the backrest portion 22.

The backrest portion 22 includes a plurality of seat adjustment fastening members 58 wherein the seat adjustment fastening members 58 are for selectively coupling the seat portion 28 to the backrest portion 22 through the seat adjustment holes 56.

The seat portion 28 includes a plurality of seat support members 60. The seat support members 60 are substantially parallel. A plurality of brace members 62 is fixedly coupled to the seat support members 60. The brace members 62 are oriented substantially perpendicular to the seat support members 60 thereby forming the seat portion 28.

The seat portion 28 includes a brace stop member 64. The brace stop member 64 is fixedly coupled to the seat support members 60 proximate the wall end 72 of the seat support members 60.

The brace stop member 64 abuts the lower end 32 of the backrest portion 22 when a pool end 66 of the seat portion 28 is pivoted downwardly. The brace stop member 64 prevents from moving past a perpendicular relationship between the seat portion 28 and the backrest portion 22 when the portions 28, 22 contact the pool wall 20 and the pool deck surface 14.

The frame sections are collapsible when the pool deck portion 12, armrest members 50, and seat portion 28 are pivoted against the backrest portion 22 for the purpose of permitting the user to store and transport the frame sections as a substantially flat unit 68.

Each of the backrest portion 22 and the seat portion 28 includes a cushion member 70. The cushion member 70 is selectively couplable to the portions 22, 28 such that the cushion members 70 are for padding the portions 22, 28 for the purpose of increased comfort for the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable poolside chair apparatus for permitting a user to sit partially submerged in a pool adjacent the pool wall, a pool deck surface being positioned adjacent to the pool wall, the portable poolside chair apparatus comprising a plurality of frame sections, said frame sections including;

a pool deck portion wherein said pool deck portion may be positioned on the pool deck surface such that a distal end and a proximal end of said pool deck portion are defined with respect to the pool wall;

a backrest portion having an upper end being pivotally coupled to said proximal end of said pool deck portion such that said deck portion may be moved from a position abutting said backrest portion to a position oriented generally perpendicular to said backrest portion, said backrest portion being oriented substantially perpendicular to said pool deck portion when said pool deck portion is positioned on the pool deck surface;

a seat portion having an edge pivotally coupled to a lower end of said backrest portion such that said seat portion may be moved from a position abutting said backrest portion to a position oriented generally perpendicular to said backrest portion;

wherein said backrest portion may be positioned against the pool wall and said pool deck portion positioned on the pool deck such that said seat portion extends away from the pool wall and defines a seat; and said pool deck portion having a plurality of support bar members, said support bar members being substantially parallel, a plurality of crossbar members being fixedly coupled to said support bar members, said crossbar members being oriented substantially perpendicular to said support bar members thereby forming said pool deck portion.

2. The portable poolside chair apparatus as set forth in claim 1, further comprising:

each of said backrest portion and said seat portion including a cushion member, said cushion member being selectively couplable to said portions such that said cushion members are for padding said portions for the purpose of increased comfort for the user.

3. The portable poolside chair apparatus as set forth in claim 1, further comprising:

said pool deck portion having a plurality of support members, said support members being fixedly coupled to said support bar members, said support members comprising a friction-enhancing material such that said support members are for contacting the pool deck surface while preventing movement of said pool deck portion when said backrest portion is extended into the pool.

4. The portable poolside chair apparatus as set forth in claim 3, further comprising:

said pool deck portion including a crossbar stop member, said crossbar stop member being fixedly coupled to said support bar members proximate said proximal end of said pool deck portion, said crossbar stop member abutting said upper end of said backrest portion when said distal end of said pool deck portion is pivoted upwardly such that said crossbar stop member prevents from moving past a perpendicular relationship between said pool deck portion and said backrest portion when said portions are in contact with the pool wall and the pool deck surface.

5. The portable poolside chair apparatus as set forth in claim 1, further comprising:

said backrest portion having a plurality of wall members, said wall members being substantially parallel, a plurality of bracket members being fixedly coupled to said wall members, said bracket members being oriented substantially perpendicular to said wall members thereby forming said backrest portion; and said backrest members being generally arcuate such that said backrest members are for conforming to the back of the user.

6. The portable poolside chair apparatus as set forth in claim 5, further comprising:

said backrest portion including a plurality of armrest members, said armrest members comprising substantially flat elongate members, a rear end of said armrest members being pivotally coupled to said wall members proximate a medial portion of said wall members, said armrest members being adapted for supporting the arms of the user when the user is positioned on said seat portion.

7. The portable poolside chair apparatus as set forth in claim 6, further comprising:

said backrest portion having a plurality of seat adjustment holes, said seat adjustment holes being positioned proximate said lower end of said backrest portion in said wall members such that said seat adjustment holes are for vertical positioning of said seat portion along said backrest portion; and said backrest portion including a plurality of seat adjustment fastening members wherein said seat adjustment fastening members are for selectively coupling said seat portion to said backrest portion through said seat adjustment holes.

8. The portable poolside chair apparatus as set forth in claim 1, further comprising:

said seat portion including a plurality of seat support members, said seat support members being substantially parallel, a plurality of brace members being fixedly coupled to said seat support members, said brace members being oriented substantially perpendicular to said seat support members thereby forming said seat portion.

9. The portable poolside chair apparatus as set forth in claim 8, further comprising:

said seat portion including a brace stop member, said brace stop member being fixedly coupled to said seat support members proximate said wall end of said seat support members, said brace stop member abutting said lower end of said backrest portion when a pool end of said seat portion is pivoted downwardly such that said brace stop member prevents movement past a perpendicular relationship between said seat portion and said backrest portion when said portions in contact with the pool wall and the pool deck surface.

10. The portable poolside chair apparatus as set forth in claim 1, further comprising:

said frame sections being collapsible when said pool deck portion and seat portion are pivoted against said backrest portion for the purpose of permitting the user to transport said frame sections as a substantially flat unit.

11. A portable poolside chair apparatus for permitting a user to sit partially submerged in a pool adjacent the pool wall, a pool deck surface being positioned adjacent to the pool wall, the portable poolside chair apparatus comprising a plurality of frame sections, said frame sections including;

a pool deck portion wherein said pool deck portion may be positioned on the pool deck surface such that a distal end and a proximal end of said pool deck portion are defined with respect to the pool wall;

a backrest portion having an upper end being pivotally coupled to said proximal end of said pool deck portion such that said deck portion may be moved from a position abutting said backrest portion to a position oriented generally perpendicular to said backrest portion, said backrest portion being oriented substantially perpendicular to said pool deck portion when said pool deck portion is positioned on the pool deck surface;

a seat portion having an edge pivotally coupled to a lower end of said backrest portion such that said seat portion may be moved from a position abutting said backrest portion to a position oriented generally perpendicular to said backrest portion;

wherein said backrest portion may be positioned against the pool wall and said pool deck portion positioned on the pool deck such that said seat portion extends away from the pool wall and defines a seat;

said pool deck portion having a plurality of support bar members, said support bar members being substantially parallel, a plurality of crossbar members being fixedly coupled to said support bar members, said crossbar members being oriented substantially perpendicular to said support bar members thereby forming said pool deck portion;

said pool deck portion having a plurality of support members, said support members being fixedly coupled to said support bar members, said support members comprising a friction-enhancing material such that said support members are for contacting the pool deck surface while preventing movement of said pool deck portion when said backrest portion is extended into the pool;

said pool deck portion including a crossbar stop member, said crossbar stop member being fixedly coupled to said support bar members proximate said proximal end of said pool deck portion, said crossbar stop member abutting said upper end of said backrest portion when said distal end of said pool deck portion is pivoted upwardly such that said crossbar stop member prevents from moving past a perpendicular relationship between said pool deck portion and said backrest portion when said portions are in contact with the pool wall and the pool deck surface;

said backrest portion having a plurality of wall members, said wall members being substantially parallel, a plurality of bracket members being fixedly coupled to said wall members, said bracket members being oriented substantially perpendicular to said wall members thereby forming said backrest portion;

said backrest members being generally arcuate such that said backrest members are for conforming to the back of the user;

said backrest portion including a plurality of armrest members, said armrest members comprising substantially flat elongate members, a rear end of said armrest members being pivotally coupled to said wall members proximate a medial portion of said wall members, said armrest members being adapted for supporting the arms of the user when the user is positioned on said seat portion;

said backrest portion having a plurality of seat adjustment holes, said seat adjustment holes being positioned proximate said lower end of said backrest portion in said wall members such that said seat adjustment holes are for vertical positioning of said seat portion along said backrest portion;

said backrest portion including a plurality of seat adjustment fastening members wherein said seat adjustment fastening members are for selectively coupling said seat portion to said backrest portion through said seat adjustment holes;

said seat portion including a plurality of seat support members, said seat support members being substantially parallel, a plurality of brace members being fixedly coupled to said seat support members, said brace members being oriented substantially perpendicular to said seat support members thereby forming said seat portion;

said seat portion including a brace stop member, said brace stop member being fixedly coupled to said seat support members proximate said wall end of said seat support members, said brace stop member abutting said lower end of said backrest portion when a pool end of said seat portion is pivoted downwardly such that said brace stop member prevents movement past a perpendicular relationship between said seat portion and said backrest portion when said portions in contact with the pool wall and the pool deck surface;

said frame sections being collapsible when said pool deck portion, armrest members, and seat portion are pivoted against said backrest portion for the purpose of permitting the user to transport said frame sections as a substantially flat unit;

each of said backrest portion and said seat portion including a cushion member, said cushion member being selectively couplable to said portions such that said cushion members are for padding said portions for the purpose of increased comfort for the user.

12. A portable poolside chair apparatus for permitting a user to sit partially submerged in a pool adjacent the pool wall, a pool deck surface being positioned adjacent to the pool wall, the portable poolside chair apparatus comprising a plurality of frame sections, said frame sections including;

a pool deck portion wherein said pool deck portion may be positioned on the pool deck surface such that a distal end and a proximal end of said pool deck portion are defined with respect to the pool wall;

a backrest portion having an upper end being pivotally coupled to said proximal end of said pool deck portion such that said deck portion may be moved from a position abutting said backrest portion to a position oriented generally perpendicular to said backrest portion, said backrest portion being oriented substantially perpendicular to said pool deck portion when said pool deck portion is positioned on the pool deck surface;

a seat portion having an edge pivotally coupled to a lower end of said backrest portion such that said seat portion may be moved from a position abutting said backrest portion to a position oriented generally perpendicular to said backrest portion;

wherein said backrest portion may be positioned against the pool wall and said pool deck portion positioned on the pool deck such that said seat portion extends away from the pool wall and defines a seat;

said backrest portion having a plurality of wall members, said wall members being substantially parallel, a plurality of bracket members being fixedly coupled to said wall members, said bracket members being oriented substantially perpendicular to said wall members thereby forming said backrest portion; and said backrest members being generally arcuate such that said backrest members are for conforming to the back of the user.

13. The portable poolside chair apparatus as set forth in claim 12, further comprising:

each of said backrest portion and said seat portion including a cushion member, said cushion member being selectively couplable to said portions such that said cushion members are for padding said portions for the purpose of increased comfort for the user.

14. The portable poolside chair apparatus as set forth in claim 12, further comprising:

said backrest portion including a plurality of armrest members, said armrest members comprising substantially flat elongate members, a rear end of said armrest members being pivotally coupled to said wall members proximate a medial portion of said wall members, said armrest members being adapted for supporting the arms of the user when the user is positioned on said seat portion.

15. The portable poolside chair apparatus as set forth in claim 14, further comprising:

said backrest portion having a plurality of seat adjustment holes, said seat adjustment holes being positioned proximate said lower end of said backrest portion in said wall members such that said seat adjustment holes are for vertical positioning of said seat portion along said backrest portion; and said backrest portion including a plurality of seat adjustment fastening members wherein said seat adjustment fastening members are for selectively coupling said seat portion to said backrest portion through said seat adjustment holes.

16. The portable poolside chair apparatus as set forth in claim 12, further comprising:

said seat portion including a plurality of seat support members, said seat support members being substantially parallel, a plurality of brace members being fixedly coupled to said seat support members, said brace members being oriented substantially perpendicular to said seat support members thereby forming said seat portion.

17. The portable poolside chair apparatus as set forth in claim 16, further comprising:

said seat portion including a brace stop member, said brace stop member being fixedly coupled to said seat support members proximate said wall end of said seat support members, said brace stop member abutting said lower end of said backrest portion when a pool end of said seat portion is pivoted downwardly such that said brace stop member prevents movement past a perpendicular relationship between said seat portion and said backrest portion when said portions in contact with the pool wall and the pool deck surface.

18. The portable poolside chair apparatus as set forth in claim 12, further comprising:

said frame sections being collapsible when said pool deck portion and seat portion are pivoted against said backrest portion for the purpose of permitting the user to transport said frame sections as a substantially flat unit.

* * * * *